US006327729B1

(12) United States Patent
Wunderlich et al.

(10) Patent No.: US 6,327,729 B1
(45) Date of Patent: Dec. 11, 2001

(54) WASHER LID HAVING FLUID DISPENSER AND METHOD FOR USING SAME

(75) Inventors: Daniel F. Wunderlich, Newton; Jeffrey L. Sears, Grinnell; Dennis L. Purtilo, Newton; Luann E. Langel, Urbandale; Kirk M. Dunsbergen, Newton, all of IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/282,746

(22) Filed: Mar. 31, 1999

(51) Int. Cl.[7] ..... D06F 39/02

(52) U.S. Cl. ..... 8/158; 68/17 R; 68/12.18; 68/207

(58) Field of Search ..... 68/17 R, 23.5, 68/23.4, 23.6, 207, 12.18; 73/427, 426; 222/44, 651

(56) References Cited

U.S. PATENT DOCUMENTS

| | | | | |
|---|---|---|---|---|
| 529,202 | * | 11/1894 | Schramm . | |
| 1,549,027 | * | 8/1925 | Perry . | |
| 2,699,886 | * | 1/1955 | James, Jr. . | |
| 2,872,076 | | 2/1959 | Bloom . | |
| 2,946,489 | | 7/1960 | Brucken . | |
| 3,029,826 | | 4/1962 | Fink et al. . | |
| 3,044,667 | | 7/1962 | Lucas . | |
| 3,127,067 | * | 3/1964 | Hall et al. | 68/17 R |
| 3,399,813 | | 9/1968 | Theyssen . | |
| 3,727,434 | | 4/1973 | Bochan . | |
| 3,805,562 | | 4/1974 | Waugh et al. . | |
| 3,822,571 | | 7/1974 | Waugh . | |
| 3,828,975 | | 8/1974 | Robandt, II et al. . | |
| 3,913,793 | | 10/1975 | D'Assuncao . | |
| 3,949,576 | | 4/1976 | Waugh et al. . | |
| 3,952,556 | | 4/1976 | Gakhar et al. . | |
| 3,974,667 | | 8/1976 | Gakhar . | |
| 4,420,951 | | 12/1983 | Clearman et al. . | |
| 4,759,202 | | 7/1988 | Caron . | |
| 5,205,304 | | 4/1993 | Cooper et al. . | |
| 5,261,432 | | 11/1993 | Sandrin . | |
| 5,291,758 | * | 3/1994 | Lee | 68/207 |
| 5,413,259 | | 5/1995 | Cerruti et al. . | |
| 5,515,876 | * | 5/1996 | Warner et al. . | |
| 6,138,693 | * | 10/2000 | Matz . | |

FOREIGN PATENT DOCUMENTS

| | | | | |
|---|---|---|---|---|
| 361780 | * | 6/1962 | (CH) | 68/207 |
| 1096319 | * | 1/1961 | (DE) | 68/17 R |
| 3637815 | * | 6/1987 | (DE) | 68/17 R |
| 3638109 | * | 5/1988 | (DE) | 68/17 R |
| 128070 | * | 12/1984 | (FR) | 68/17 R |
| 53-9069 | * | 1/1978 | (JP) | 68/17 R |

OTHER PUBLICATIONS

European Patent Office 582,092 68/17R, Feb. 1994.*
WIPO 82/00482 68/17R, Feb. 1982.*

* cited by examiner

*Primary Examiner*—Frankie L. Stinson
(74) *Attorney, Agent, or Firm*—Zarley, McKee, Thomte, Voorhees & Sease

(57) ABSTRACT

A washing machine lid includes a fluid chamber on its lower surface. The fluid chamber has a fill opening and a dispensing opening. A removable valve is within the dispensing opening. The lid includes a lid frame and a housing detachably mounted to one another.

34 Claims, 12 Drawing Sheets

WASHER LID HAVING FLUID DISPENSER AND METHOD FOR USING SAME

BACKGROUND OF THE INVENTION

FIELD OF THE INVENTION

The present invention relates to a washer lid having a fluid dispenser and a method for using same.

Many devices have been used for dispensing fluids such as liquid detergents into washing machines. Some of these devices have been provided inside the washing machine and some have been provided on the lid for the washing machine. These prior art devices however have been deficient in many respects.

Many of these devices have been small in volume. They also failed to provide a satisfactory means for metering the amount of fluid dispensed, and for permitting the user to determine the amount of fluid left in the dispenser.

Therefore, a primary object of the present invention is the provision of an improved washer lid having a fluid dispenser thereon and the method for using same.

A further object of the present invention is the provision of an improved washer lid having a fluid dispenser which will hold a large quantity of fluid for use in many washing loads.

A further object of the present invention is the provision of an improved washer lid having a fluid dispenser which is comprised of two chambers, one of which is a reservoir chamber and the other of which is a dispensing chamber.

A further object of the present invention is the provision of an improved washer lid which includes a counter balance for counter balancing the weight of the fluid in the fluid dispenser.

A further object of the present invention is the provision of an improved washer lid and method for using same which permits the metering of the amount of fluid to be dispensed.

A further object of the present invention is the provision of an improved washer lid having a dispenser which contains a viewing window therein for observing the quantity of fluid within the dispensing chamber.

A further object of the present invention is the provision of an improved washer lid having a fluid dispenser with a window and a movable marker for marking the level of fluid desired to be dispensed.

A further object of the present invention is the provision of an improved washer lid which includes a fluid dispenser and a seal for sealing condensation inside the washer when the lid is closed.

A further object of the present invention is the provision of an improved washer lid having a fluid dispenser with a valve for dispensing fluid from the fluid dispenser.

A further object of the present invention is the provision of an improved washer lid having a fluid dispenser with a removable valve which can be easily removed and cleaned.

A further object of the present invention is the provision of an improved lid having a fluid dispenser which is registered above the washer access opening when the lid is in its open position so that fluid can be dispensed directly into the access opening by gravity.

A further object of the present invention is the provision of an improved lid which recharges the dispensing chamber each time the lid is moved to its closed position.

A further object of the present invention is the provision of an improved lid having a dispenser with a dispensing spout that minimizes dripping.

A further object of the present invention is the provision of an improved washer lid which is comprised of a metal lid frame and a plastic housing detachably connected to the metal frame.

A further object of the present invention is the provision of an improved washer lid having a fluid dispenser therein which is economical to manufacture, durable in use, attractive in appearance, and efficient in operation.

SUMMARY OF THE INVENTION

The foregoing objects may be achieved by a lid for a washing machine having a washing machine cabinet with an upwardly presented access opening therein. The lid includes a lid frame having a front edge, a rear edge, side edges, an upper surface and a lower surface. A hinge is connected to one of the edges of the lid frame for permitting hinged attachment of the lid to the washing machine cabinet for pivotal movement between an open position wherein the upper and lower surfaces are upstanding and a closed position wherein the lid is in covering relation over the access opening. A dispenser housing is carried on the lower surface of the lid frame and forms an enclosed chamber, the chamber having a lowest portion when the lid is in the open position. The dispenser housing includes a dispensing opening located adjacent the lowest portion of the chamber and forming a communication path from within the chamber to outside the chamber. The dispenser housing also includes a fill opening providing communication into the chamber for filling the chamber with a fluid up to a predetermined maximum level. A fill cap is detachably connected to the fill opening. A dispensing valve is mounted in the dispensing opening and is movable from a closed position preventing fluid from leaving the chamber through the dispensing opening to an open position permitting fluid to exit through the dispensing opening when the lid is in its open position.

The chamber may be comprised of a reservoir chamber and a dispensing chamber, with the fill opening being in the reservoir chamber and the dispensing opening being in the dispensing chamber. The dispensing chamber includes a charging opening providing fluid communication between the reservoir chamber and the dispensing chamber.

According to one feature of the invention, the charging opening is oriented to prevent fluid flow from the reservoir chamber through the charging opening to the dispensing chamber when the lid is in its open position and to permit fluid flow from the reservoir chamber through the charging opening to the dispensing chamber when the lid is in its closed position.

One feature of the invention includes a reservoir window mounted within the housing to permit observation of the level of fluid within the reservoir chamber.

Another feature of the present invention includes a dispensing window in the dispensing chamber to permit observation of the level of fluid within the dispensing chamber.

Another feature of the present invention is the provision of a sliding gage or marker member which is mounted to the dispensing window for selective manual movement along the longitudinal axis of the window.

Another feature of the present invention includes a valve which is detachably mounted within the dispensing opening for permitting the removal of the valve for cleaning.

Another feature of the present invention includes a dispensing tube having a spout which is inclined in a plane oblique to the longitudinal axis of the tube.

Another feature of the present invention is the provision of a dispenser housing which is detachably mounted to the lid and which can be removed from the lid.

Another feature of the present invention includes a counter balance assembly mounted to the lid for yieldably urging the lid to its open position against the weight of the fluid within the fluid dispenser.

A method according to the present invention includes the steps of moving the lid about its hinge axis from a closed position wherein the lid is in covering relation over the washing machine access opening to an upstanding position. The valve is then moved from a closed position preventing the fluid from exiting the chamber through a dispensing opening to an open position permitting the fluid to exit the chamber through the dispensing opening. The dispensing opening is located above the access opening of the washer when the lid is in its upright position whereby the fluid exiting from the dispensing opening will fall by gravity into the access opening.

Another feature of the method of the present invention includes moving the fluid from a reservoir chamber to a dispensing chamber through a charging opening in the dispensing chamber. One feature of this method includes charging the dispensing chamber by moving the lid to a predetermined orientation whereby the fluid will pass through the charging opening from the reservoir chamber to the dispensing chamber.

DETAILED DESCRIPTION OF THE PREFERRED EMBODIMENT

Figures 1, 2:
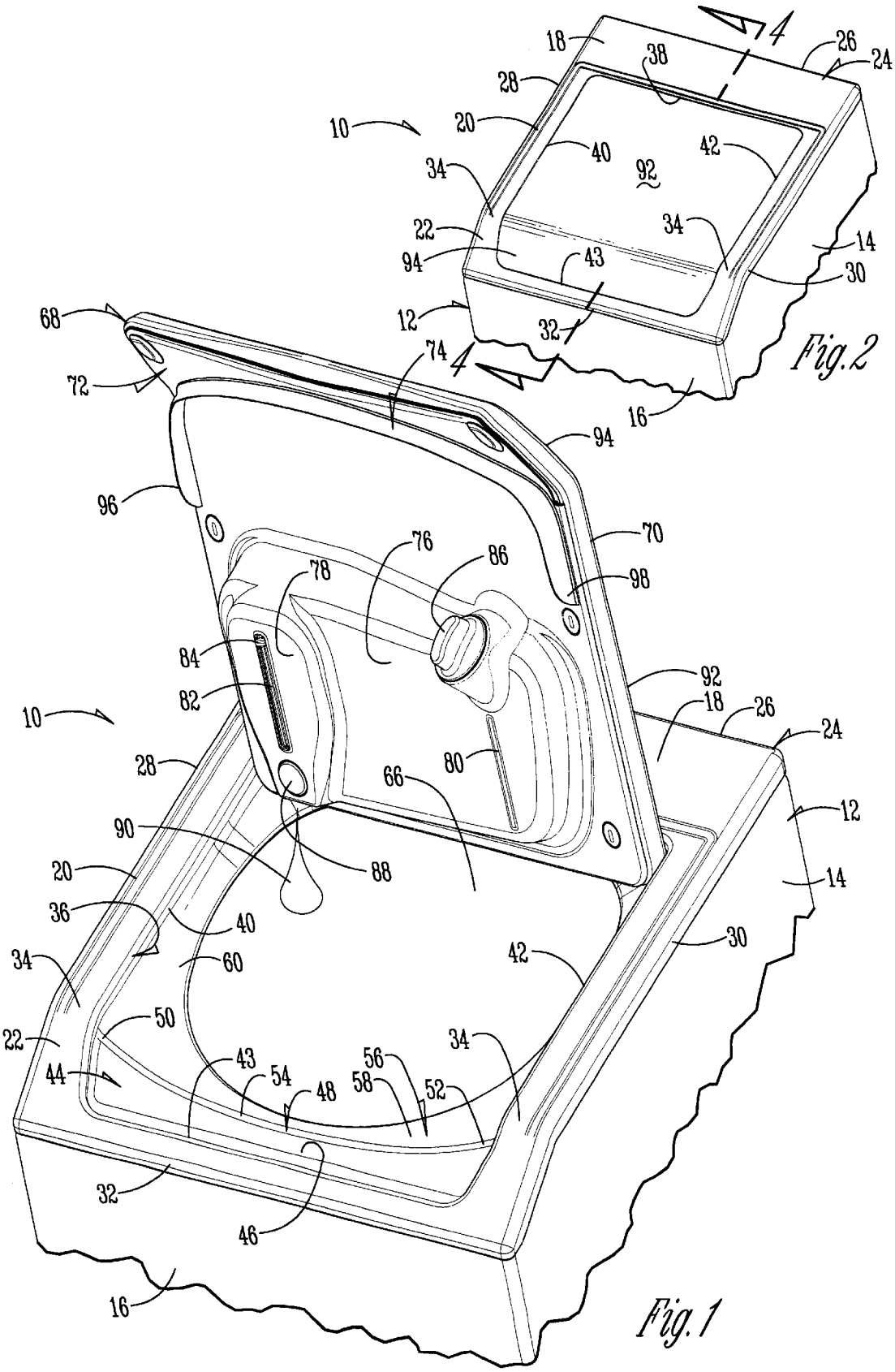
FIG. 1 is a perspective view of the present invention.
FIG. 2 is a view similar to FIG. 1, but showing the washer lid in its closed position.

Referring to the drawings the numeral 10 generally designates a clothes washer using a lid assembly 68 having the fluid dispenser of the present invention. Washer 10 includes a cabinet 12 having side walls 14, a front wall 16 and a top wall 18. Top wall 18 includes a horizontal portion 20 and an inclined portion 22 which extends downwardly and forwardly from the front edge of the horizontal portion 20. The top wall 18 is provided by a top cover 24 having a rear edge 26, side edges 28, 30, and a front edge 32. A juncture or bend 34 divides the horizontal portion 20 from the inclined portion 22 of the top surface of the top cover 24.

Provided within top cover 24 is a door depression 36 having a rear edge 38, side edges 40, 42 and a front edge 43. Extending upwardly and rearwardly from the front edge 43 is a lip flange 44 having a lower front edge 46 which extends upwardly and rearwardly to a ridge 48. Ridge 48 includes opposite ends 50, 52 and an intermediate portion 54. Intermediate portion 54 is slightly below the ends 50, 52 and is also positioned forwardly from ends 50, 52.

Extending downwardly and inwardly from ridge 48 is a generally circular skirt 56 having a front drain surface 58, side drain surfaces 60, 62, and a rear drain surface 64 all of which surround an access opening 66.

Figure 3:
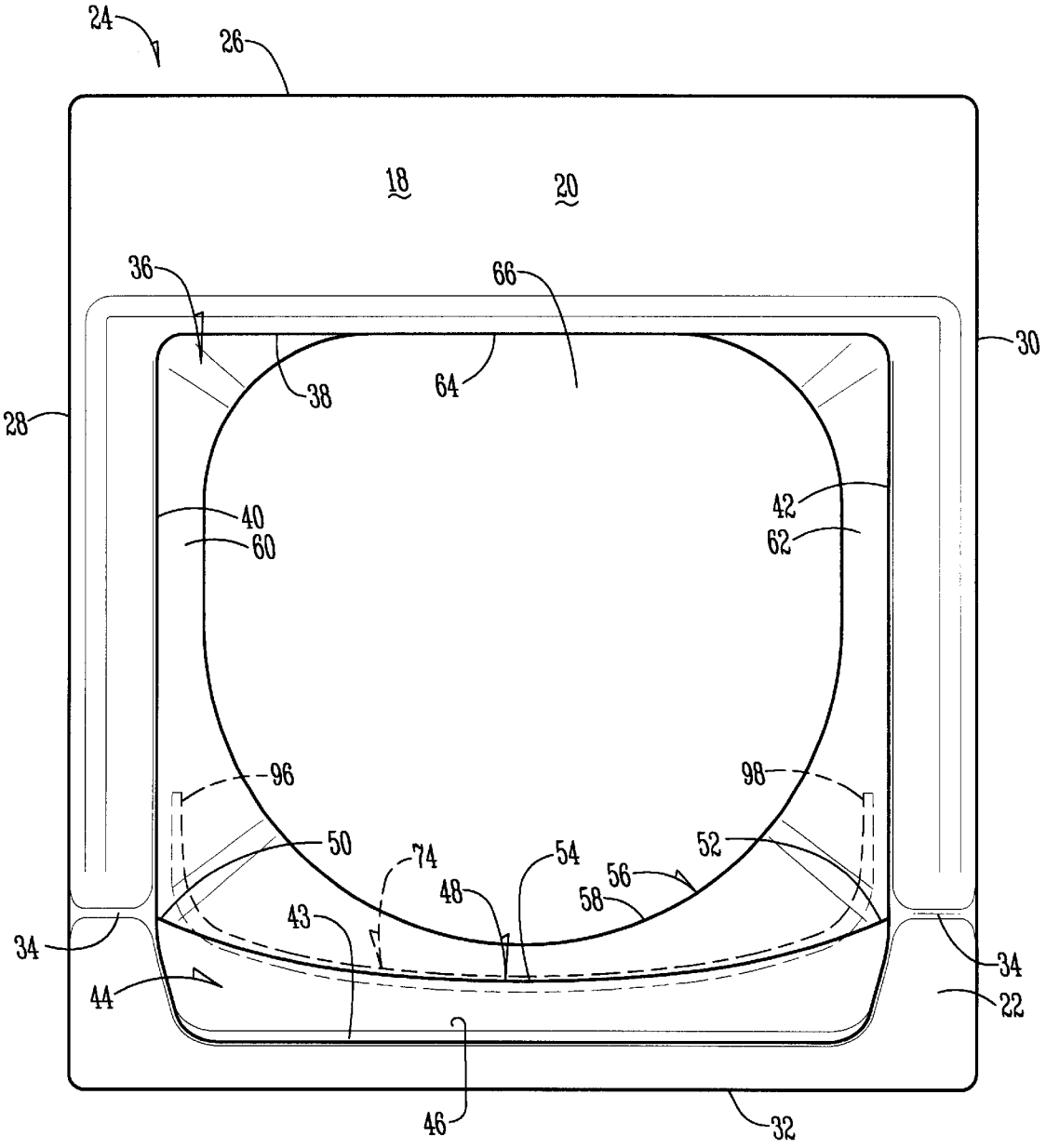
FIG. 3 is a top plan view of the top cover of the present invention showing in phantom lines the position of the sealing gasket when the lid is closed.

Top lid assembly 68 is comprised of a metal lid frame 70 and a plastic dispenser housing 72 which are detachably secured together. Plastic dispenser housing 72 includes a gasket seal 74 (FIG. 1), and a fluid chamber formed by a reservoir chamber wall 76 and a dispensing chamber wall 78. Gasket seal 74 is elongated and includes a left end 96 and a right end 98. As best shown in FIGS. 1 and 3, gasket seal 74 extends across the front of the washer door depression 36 and generally across the ridge 48. The gasket seal 74 retains condensation in the area of the door depression 36 and also provides a reduction in agitation noise that otherwise might escape from the access opening 66 of the washer 10.

A reservoir viewing window 80 is provided in reservoir chamber wall 76 and a dispensing viewing window 82 is provided in dispenser chamber wall 78. A sliding indicator or gage 84 is mounted on a track associated with window 82 and is operable for movement along the length of the dispenser viewing window 82. The sliding indicator 84 can be manually set as a marker at any of a plurality of positions along the length of the window 82. Plastic dispenser housing 72 also includes a fill cap 86 which is detachably mounted over a fill opening 87 and a dispenser button 88 for dispensing fluid 90 from the dispensing chamber in a manner to be described in more detail hereafter.

Metal lid frame 70 includes a horizontal surface 92 (when the lid is in its closed position) and an inclined surface 94.

Figure 4:
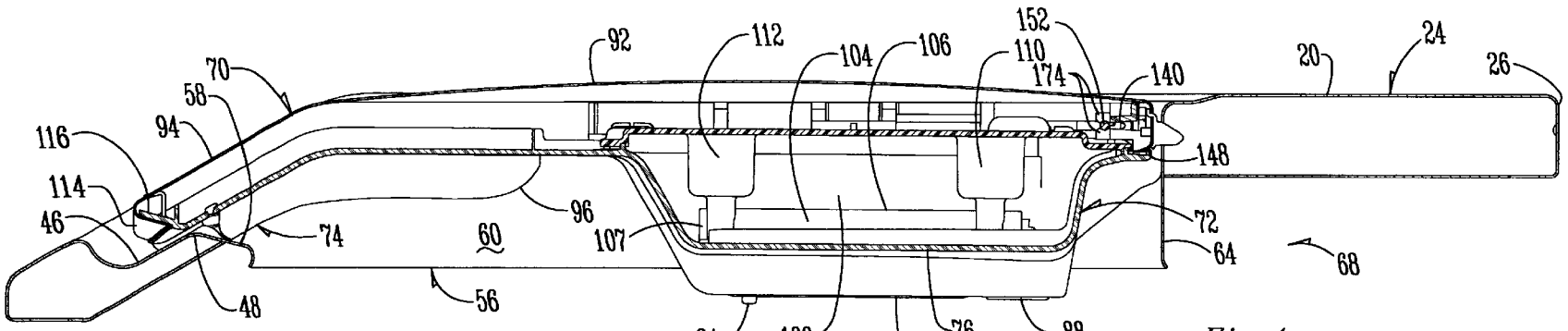
FIG. 4 is a sectional view taken along line 4—4 of FIG. 2.
Figure 7:
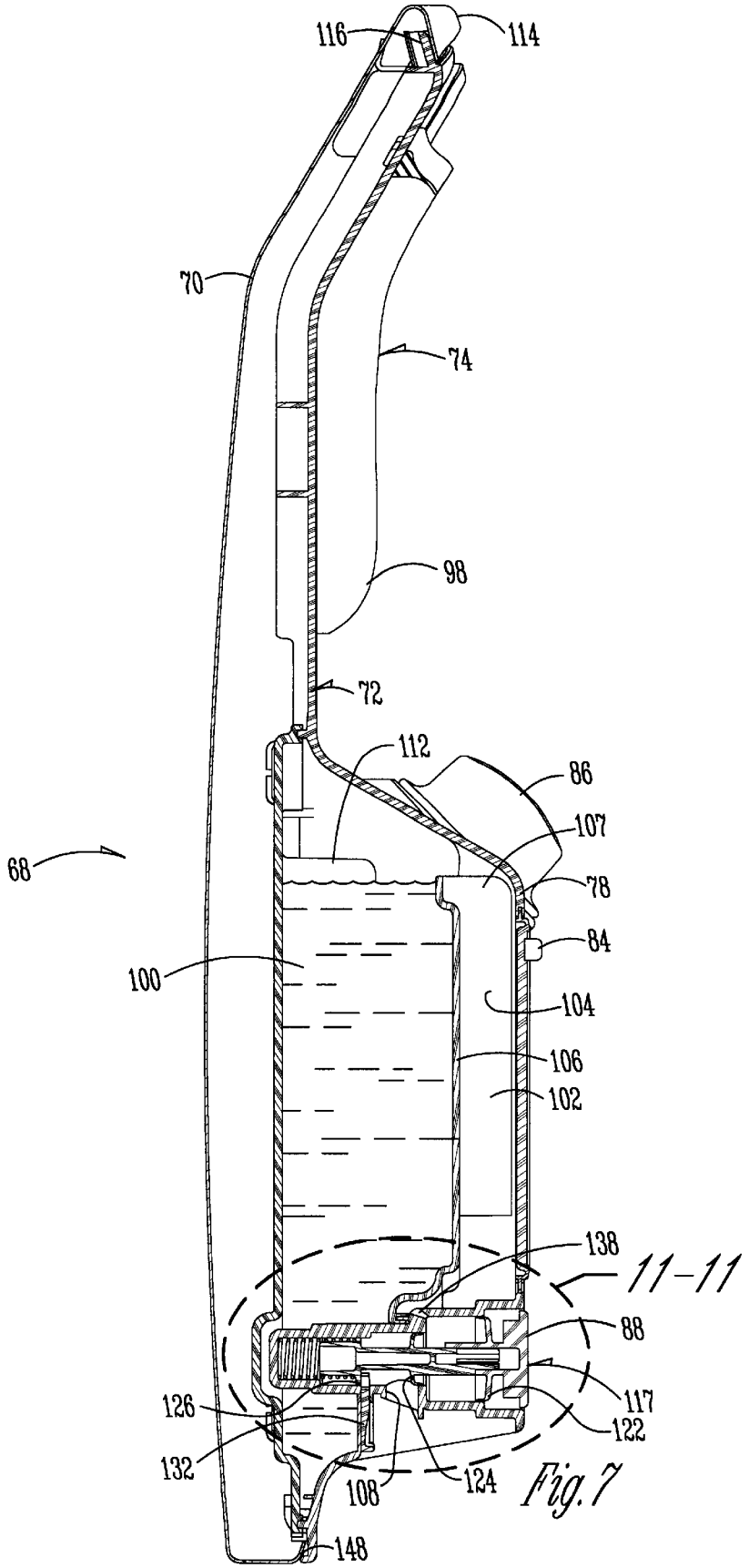
FIG. 7 is a sectional view showing the level of fluid within the reservoir chamber before the dispensing chamber has been charged.

Behind reservoir chamber wall 76 is a reservoir chamber 100 (FIG. 4), and behind dispenser wall 78 is a dispensing chamber 102 (FIG. 7). Dispensing chamber 102 is contained within reservoir chamber 100 and includes side walls 104, a rear wall 106, and a dispenser spout 108 which provides a dispenser opening for permitting fluid to exit from dispenser chamber 102. The portion of the dispensing chamber 102 formed by walls 104 and 106 is attached to front wall 76 by an interference fit and a slight amount of fluid can leak by the attachment point.

Within reservoir chamber 100 are several stand offs 110, 112 which provide structural support to the walls within the reservoir chamber 100.

Figure 5:
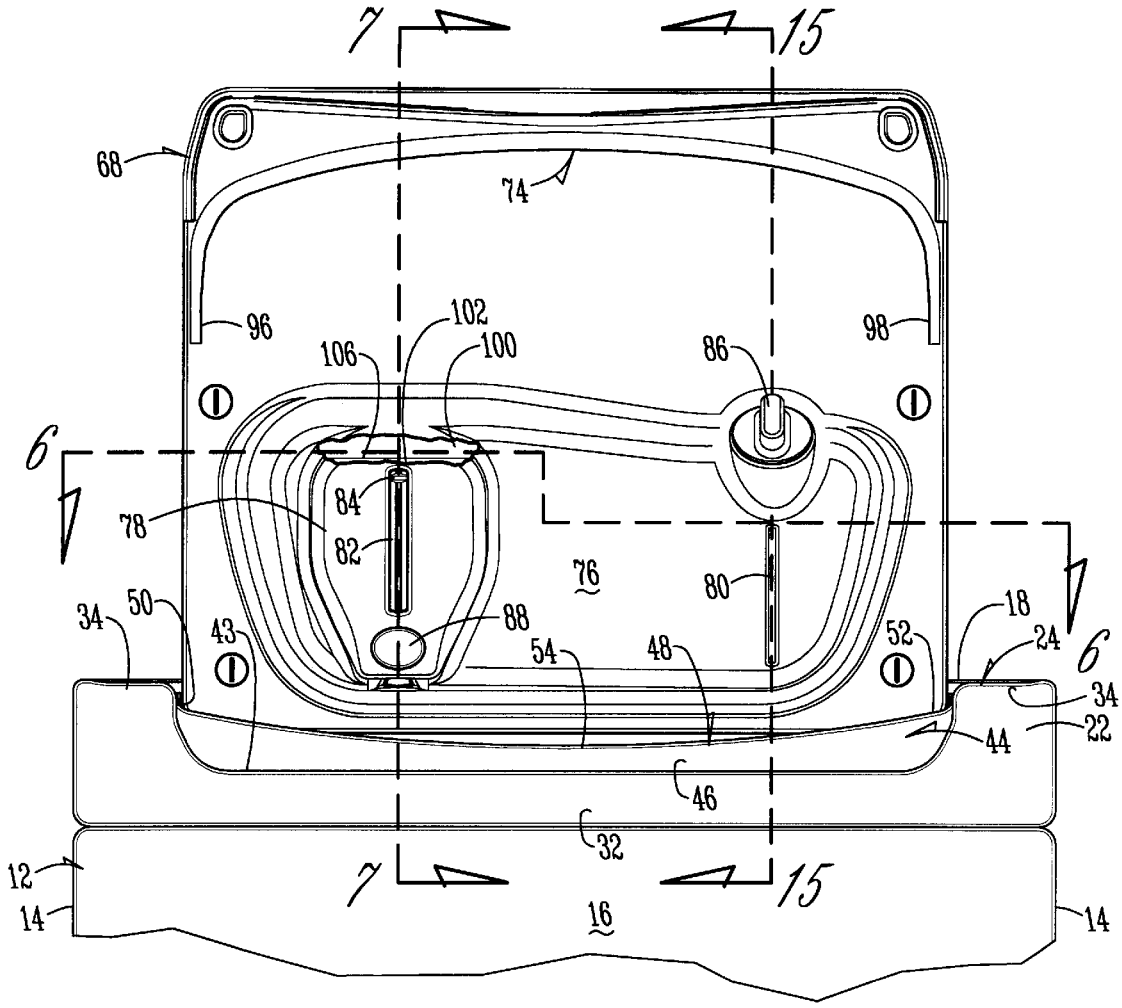
FIG. 5 is a front elevational view taken from the front of the washing machine as viewed in FIG. 1.
Figure 15:
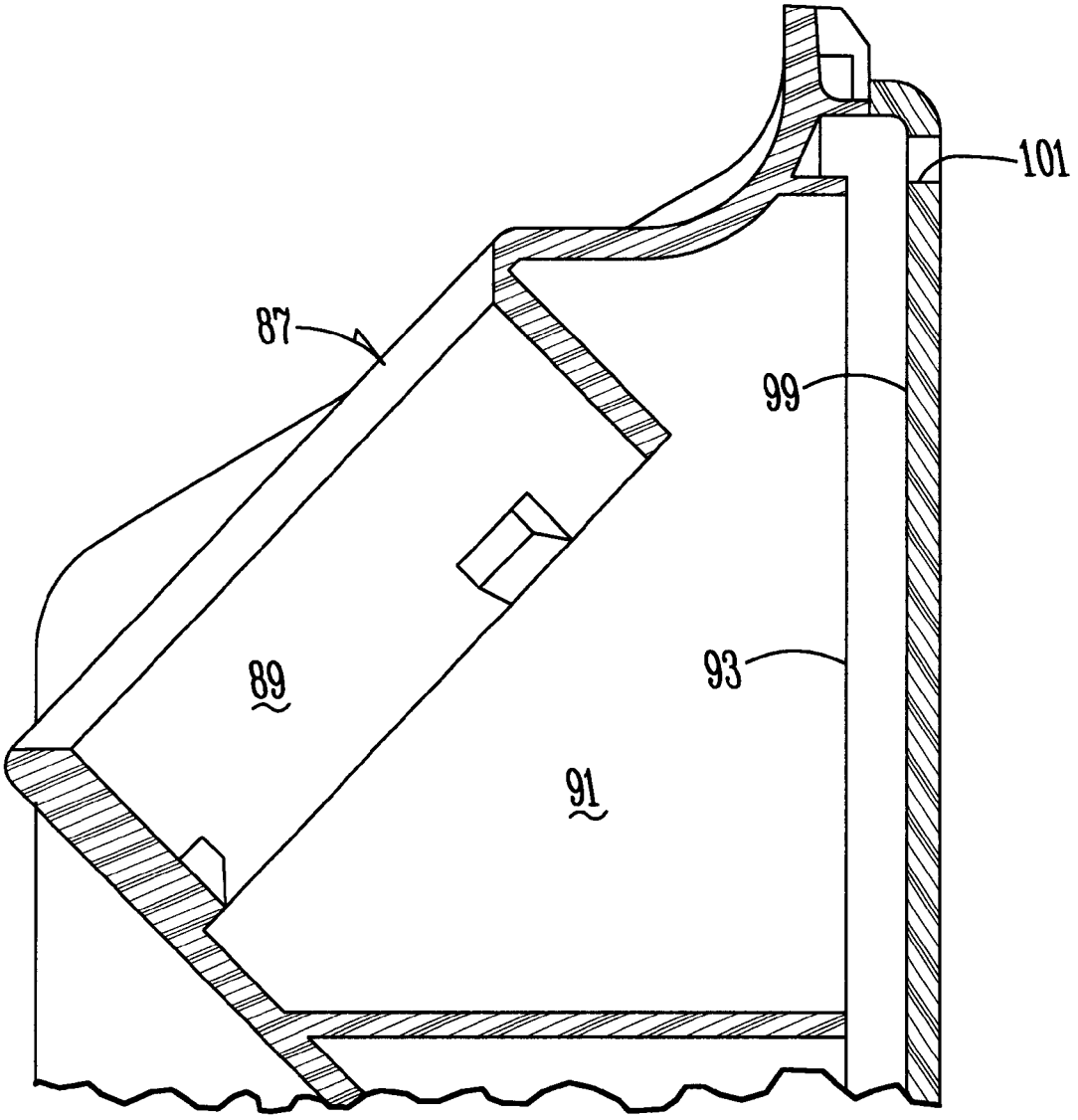
FIG. 15 is a sectional view taken generally along line 15—15 of FIG. 5.

Referring now to FIG. 15, the fill opening 87 is shown without fill cap 86 in place. With the lid assembly 68 in the generally vertical posture of FIGS. 1 and 5, the fill opening 87 is formed with a downwardly angled entry portion 89 through wall 76 and a substantially horizontally disposed cylindrical exit portion 91. The back edge 93 of the exit portion 91 is in close proximity to and generally parallel to the back wall 99 of the reservoir chamber 100. When fluid is poured into the fill opening 87, it will flow into the exit portion 91 and will enter the reservoir chamber 100. The fill can continue until fluid is observed at the lower lip of exit portion 91 at which point the reservoir chamber 100 is full. When the lid assembly 68 is in the closed horizontal posture of FIG. 4, the fluid in the reservoir chamber 100 will always be below the back edge 93 of the exit portion 91. Thus, if the operator should forget to replace the fill cap 86, there would not be any spilling of fluid out the fill opening 87. In fact, fill cap 86 could be left off if desired. Further shown in FIG. 15 is a vent opening 101 that allows the reservoir chamber 100 to breath freely preventing any airlock condition.

Plastic housing 72 is nested within the metal lid frame 70 and is fitted beneath the curled front edge 114. The peripheral edges of the housing 72 rest on the side edges 144, 146 (FIG. 13) and rear edge 148 of the metal lid frame 70. The front edge 116 of the plastic housing 72 nests under the front curled edge 114 of the lid frame 70.

Figure 10:
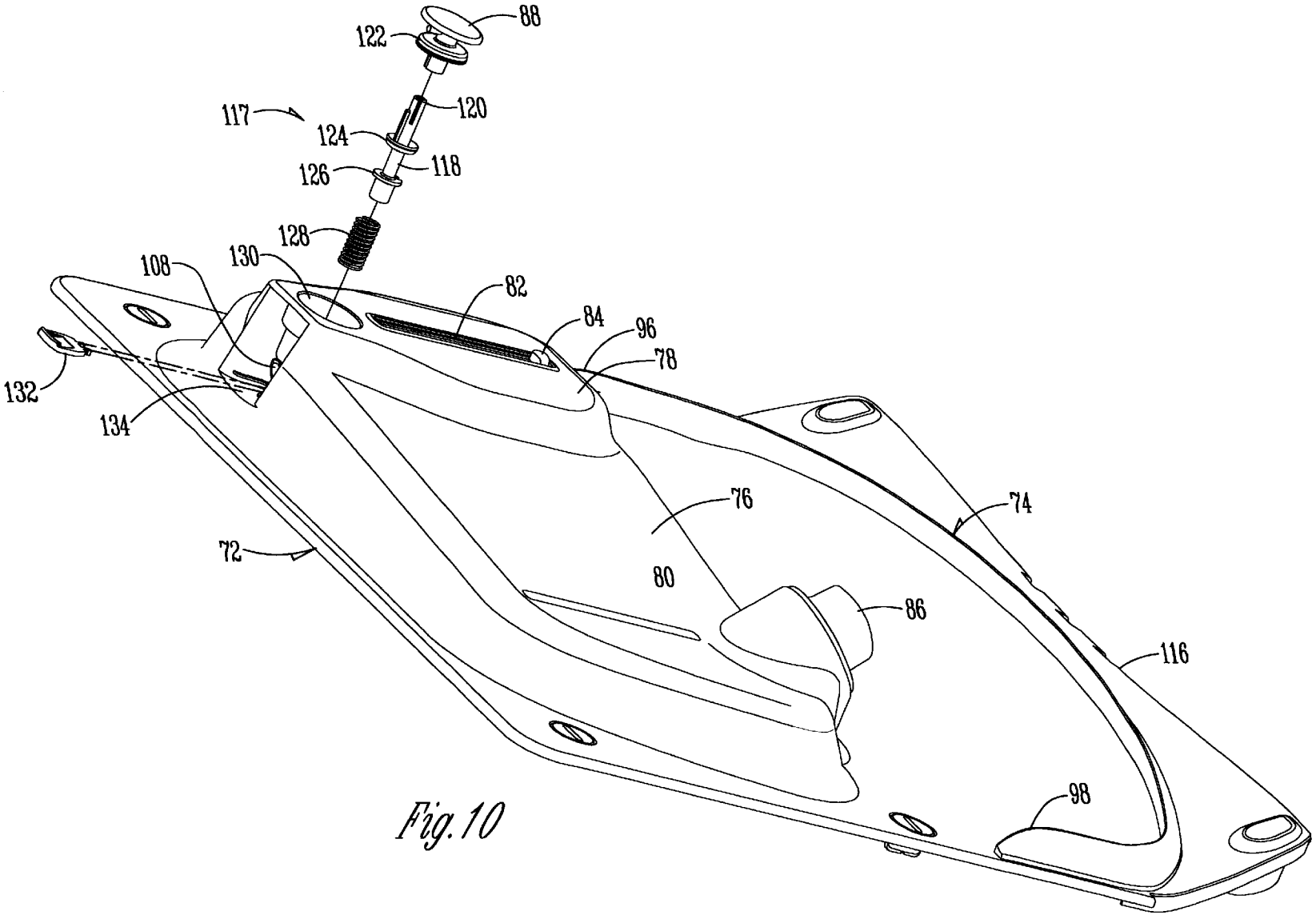
FIG. 10 is a perspective view of the plastic dispenser housing of the present invention, showing the valve in an exploded view.
Figure 11:
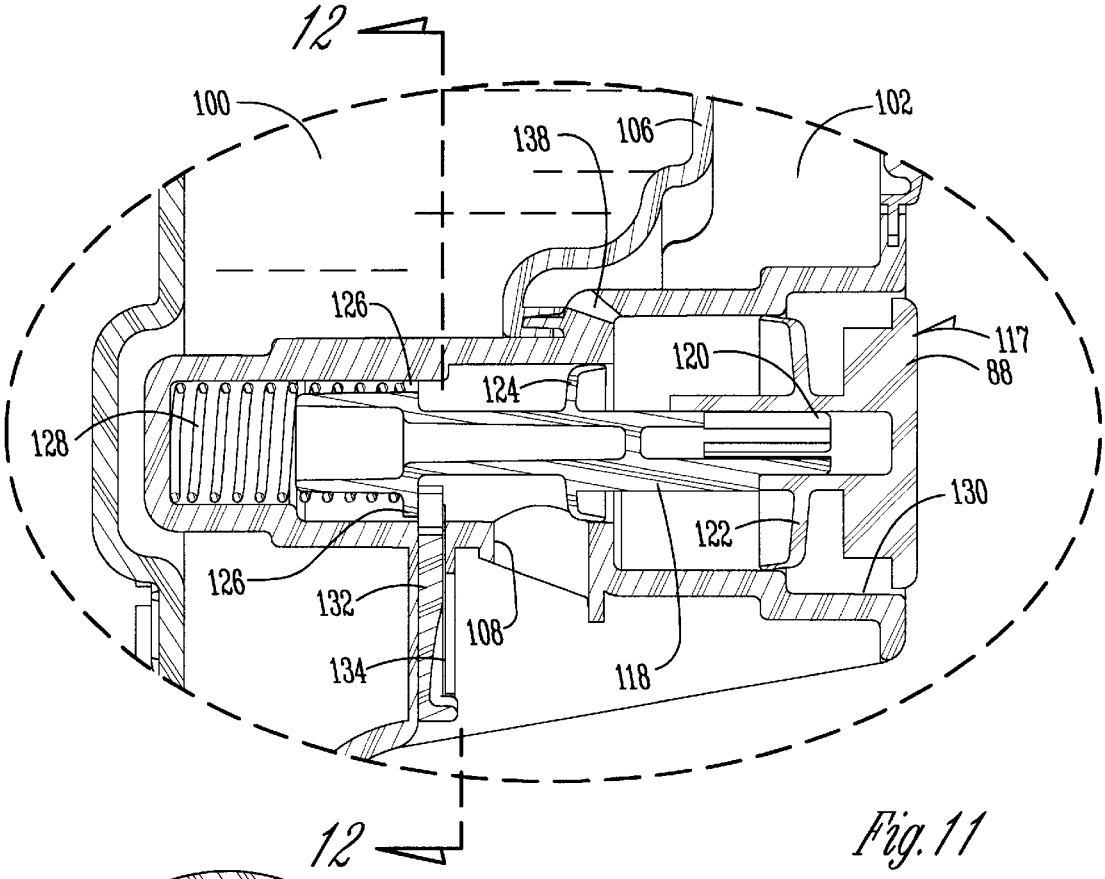
FIG. 11 is an enlarged sectional view taken along line 11—11 of FIG. 7.
Figure 12:
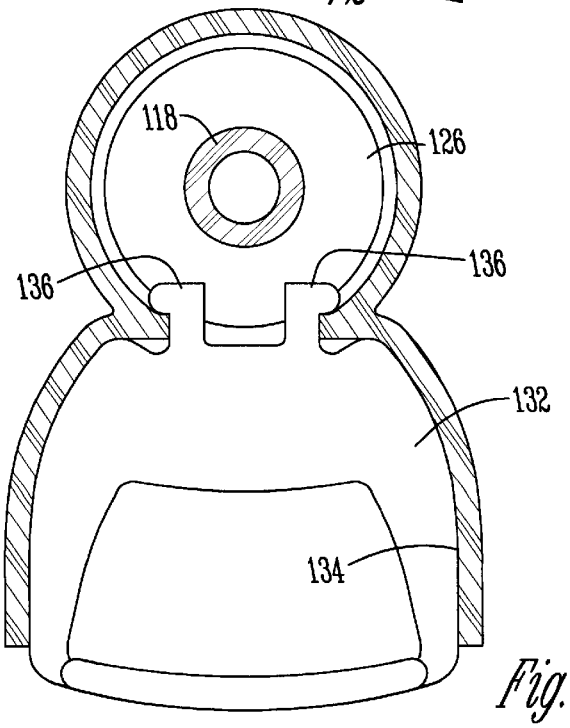
FIG. 12 is a sectional view taken along line 12—12 of FIG. 11.

Referring to FIGS. 10 and 11, a valve assembly 117 comprises a valve stem 118 having an upper end 120. Dispenser button 88 is fitted over the upper end 120 and includes a sealing flange 122 thereon. Valve stem 118 includes a valving flange 124 and a retaining flange 126. A coil spring 128 is fitted over the lower end of the valve stem 118. The valve assembly 117 is fitted within a valve receiving bore 130 in the housing 72. A retaining clip 132 is fitted within a retaining clip slot 134 and includes clip fingers 136 (FIG. 12) which retentively engage the retaining flange 126 to hold the valve assembly 117 within valve receiving bore 130. The clip fingers 136 of retaining clip 132 are yieldably movable toward one another to permit the clip 132 to be removed so as to permit removal of the valve assembly 117. This permits the easy removal of the valve assembly 117 for cleaning.

Referring to FIG. 11 a dispenser port 138 provides communication from dispensing chamber 102 to the valve receiving bore 130. Fluid is permitted to enter the axial space between the valving flange 124 and the sealing flange 122. Depression of button 88 causes the valving flange 124 to move to the left of the dispenser spout 108 as viewed in FIG. 11 thereby permitting fluid to flow out of the dispenser spout 108. Removal of pressure from the button 88 permits the spring 128 to return the valve flange 124 to its original position, thereby cutting off the flow of fluid from the dispenser chamber 102.

Figure 6:
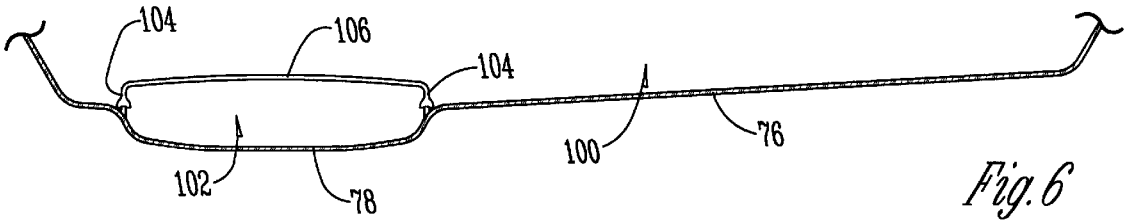
FIG. 6 is a partial sectional view taken along line 6—6 of FIG. 5.
Figure 8:
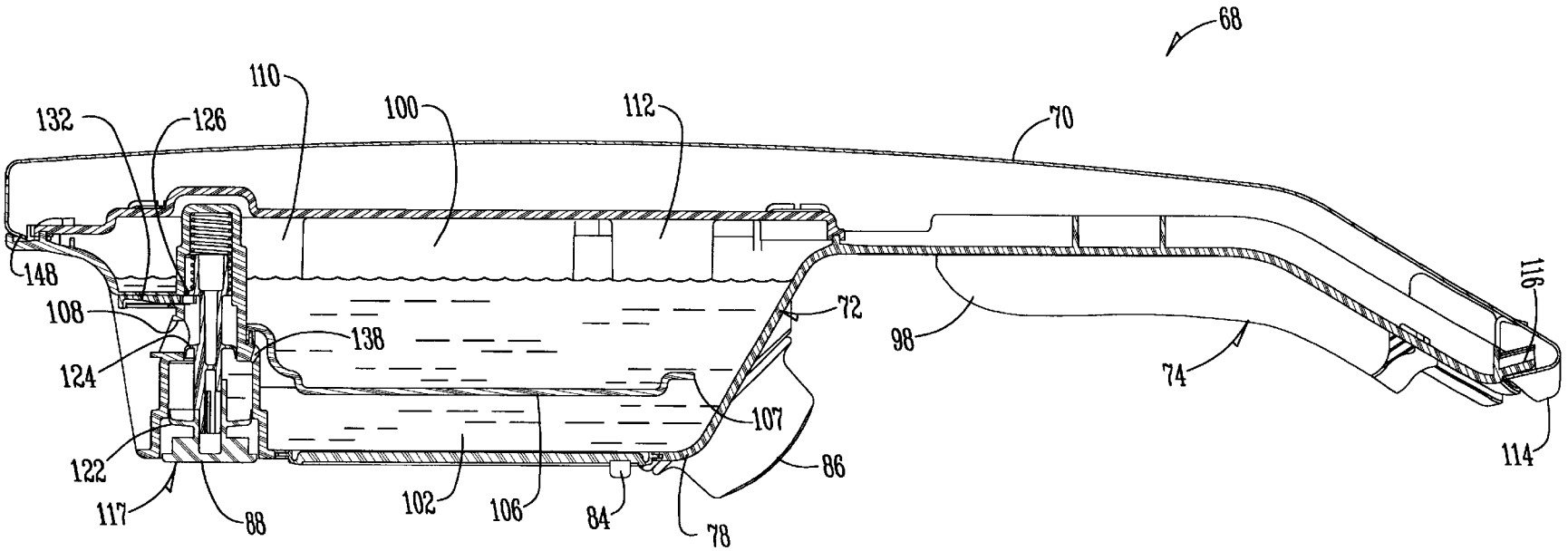
FIG. 8 is a view similar to FIG. 7, but showing the lid in its horizontal position with the fluid passing from the reservoir chamber into the dispensing chamber.
Figure 9:
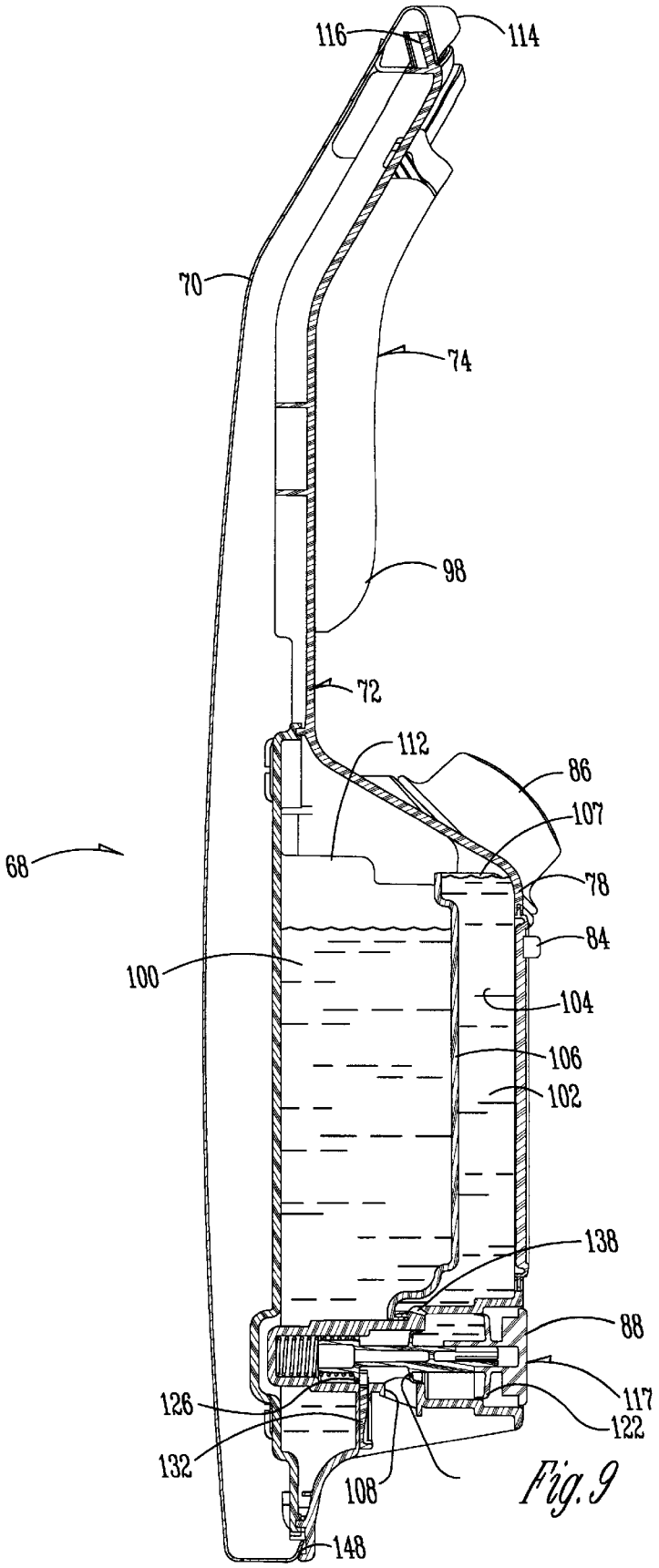
FIG. 9 is a view similar to FIG. 7 and 8 showing the lid returned to its upstanding position with the dispensing chamber being fully charged with fluid.

FIGS. 7, 8, and 9 illustrate the method of using the dispenser chamber 102 and the reservoir chamber 100 of the present invention. Initially the lid assembly 68 is moved to its up-standing position shown in FIG. 7. The fill cap 86 is removed and fluid such as liquid detergent is poured into the reservoir chamber 100 until fluid is observed at the lower lip or exit portion 91 of the fill opening 87. As can be seen in FIG. 6, the front walls 76, 78 of the chambers 100, 102 are inclined toward the dispensing chamber 102 thereby causing any fluid within chamber 100 to move toward the dispensing chamber 102 when the lid assembly 68 is lowered.

As can be seen in FIG. 7 the initial filling of the reservoir chamber 100 does not cause any substantial amount of fluid to be within the dispensing chamber 102. However, when the lid assembly 68 is moved to its closed position (FIG. 8) the fluid within chamber 100 flows around the rear wall 106 and both of the side walls 104 of chamber 102 and enters chamber 102 through a charging opening 107 adjacent the rear wall 106. Returning the lid assembly 68 to its upright position as shown in FIG. 9 causes the dispenser chamber 102 to be full and ready for dispensing fluid through spout 108.

The operator then depresses the button 88 and observes through window 82 as the fluid level lowers within dispenser chamber 102. The operator can determine, by dispensing a predetermined quantity of fluid into a measuring container, what the level of the fluid within the dispensing chamber should be after the proper amount has been dispensed. The operator can then move the sliding indicator 84 to mark that position and thereafter can release the button 88 when the level of fluid reaches the level of the sliding indicator 84. Thus, the sliding indicator 84 is set to the proper level for a particular brand or concentration of detergent.

On occasion the detergent may clog or foul the valve assembly 117. This can easily be remedied by pulling out clip 132 and removing the valve assembly for cleaning. The valve assembly 117 can then be reinserted, and the clip 132 is inserted to retain the valve assembly 117 in position for operation.

Figure 13:
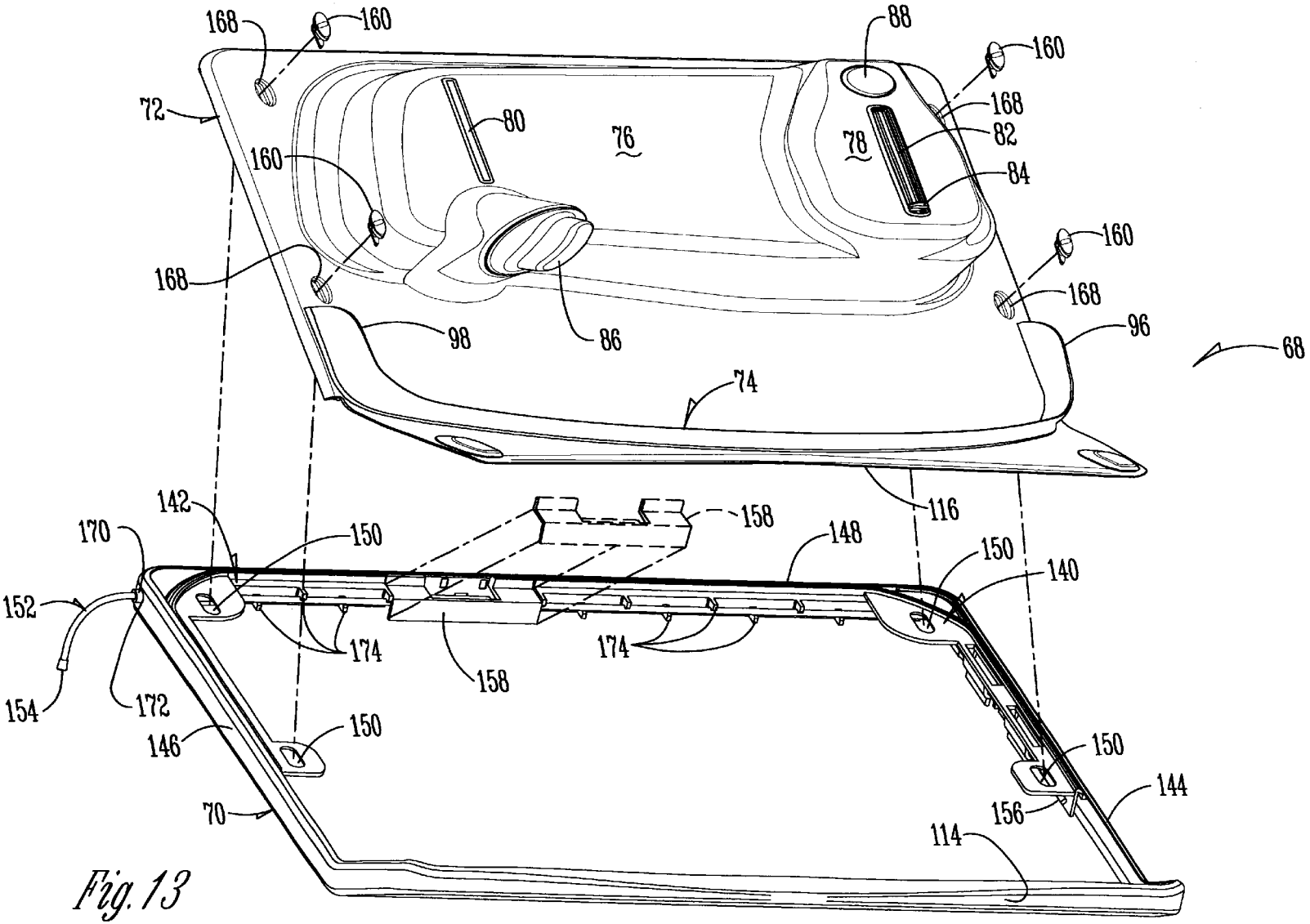
FIG. 13 is an exploded perspective view showing the interrelationship of the plastic dispenser housing, mounting bracketry and the metal lid frame.
Figure 14:
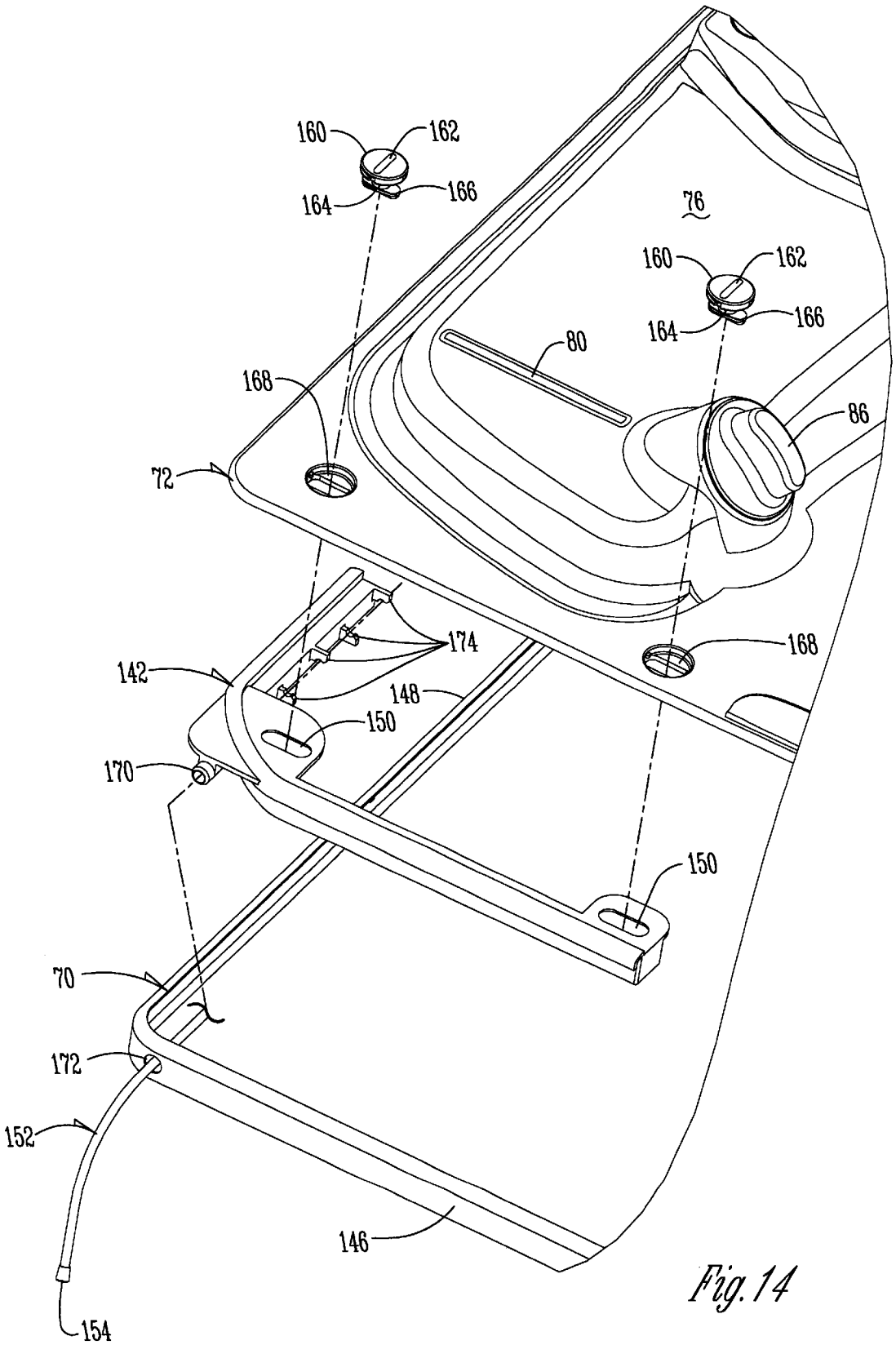
FIG. 14 is an enlarged exploded view of one corner of the assembly of FIG. 13.

Referring to FIGS. 13 and 14, the present invention utilizes a novel means for attaching the plastic housing 72 to the metal lid frame 70. Two L-shaped brackets 140, 142 are fitted in the rear corners of the metal lid frame 70 under the edges 144, 146, 148 as shown in FIGS. 13 and 14. L-shaped brackets 140, 142 are each provided with elongated slots 150 and are also provided with a bushing 170 which fits within a spring hole 172 of the metal lid frame 70. Bushing 170 includes a cylindrical bore extending therethrough and a torsion rod spring 152 is fitted through the bore in bushing 170. Torsion rod spring 152 includes a first end 154 and a second end 156 (FIG. 13). The second end 156 engages the L-shaped bracket 140, and the first end 154 is outside the top lid assembly 68 and is adapted to engage the underside of top cover 24 to provide a counter balance to the lid assembly, counter balancing the weight provided by the fluid in the reservoir and dispensing chambers 100 and 102.

A center link clamp 158 is clamped over the torsion rod spring 152 between the two L-shaped brackets 140, 142 so as to lock the L-shaped brackets beneath the curled lip flanges 144, 146 on the sides of metal lid frame 70. The spring 152 is held to the L-shaped brackets 140, 142 and the center link clamp 158 by spring finger clamps 174.

Four retainer pegs 160 each include a slot 162, a shank 164 and an elongated tab 166. These pegs 160 are fitted within holes 168 in housing 72 and the elongated tabs 166 fit within the elongated slots 150 of the L-shaped brackets 140, 142. Rotation of the pegs 160 causes the elongated tabs 166 to turn below the slots 150 so as to retentively attach the housing 72 within the metal lid frame 70. This attachment of the housing 72 to the frame 70 allows quick removal of the housing 72 so that it may be taken to a sink for flushing or cleaning should it become clogged by liquid detergents or their residue. Further, the unique system for attachment of the housing 72 to the lid frame 70 allows the housing 72 to be easily installed as an accessory since the same lid frame is used with or without the housing 72

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A lid for a washing machine having a cabinet with an upwardly presented access opening therein, comprising:

a lid frame having a front edge, a rear edge, side edges, an upper surface, and a lower surface;

a hinge connected to one of said edges of said lid frame permitting hinged attachment of said lid frame to said cabinet for pivotal movement between an open position wherein said upper and lower surfaces are upstanding and a closed position wherein said lid is in covering relation over said access opening;

a housing carried on said lower surface of said lid frame and forming an enclosed chamber, said chamber having a lowest portion when said lid is in said open position;

said housing having a dispensing opening located adjacent said lowest portion and communicating from within to outside said chamber;

said housing having a fill opening providing communication into said chamber for filling said chamber with a fluid;

a manually operated dispensing valve mounted in said dispensing opening and manually movable from a normally closed position preventing fluid from leaving said chamber through said dispensing opening to an open position permitting fluid to exit through said dispensing opening when said lid frame is in said open position; and said dispensing opening being located above said access opening when said lid frame is in said open position whereby fluid exiting from said dispensing opening will fall by gravity into said access opening.

2. A lid according to claim 1 wherein said chamber is comprised of a reservoir chamber and a dispensing chamber, said fill opening being in said reservoir chamber and said dispensing opening being in said dispensing chamber.

3. A lid according to claim 2 wherein said chamber includes front and back walls and said fill opening has fill structure that extends through the front wall, into the chamber and terminates in juxtaposition to said back wall to define a fill level limiter.

4. A lid according to claim 3 wherein said fill structure in juxtaposition to said back wall prevents spilling of fluid when said lid is in said closed position.

5. A lid according to claim 2 wherein said dispensing chamber includes a charging opening providing fluid communication between said reservoir chamber and said dispensing chamber, said charging opening being oriented to prevent fluid flow from said reservoir chamber to said dispensing chamber when said lid is in said open position, and to permit fluid flow from said reservoir chamber to said dispensing chamber when said lid is in said closed position.

6. A lid according to claim 2 wherein said reservoir chamber includes a reservoir window to permit observation of the level of fluid within said reservoir chamber.

7. A lid according to claim 2 wherein said dispensing chamber includes a dispensing window to permit observation of the level of fluid within said dispensing chamber.

8. A lid according to claim 7 wherein said dispensing window has a longitudinal axis, and a gage member is mounted to said dispensing window for selective manual movement along said longitudinal axis thereof.

9. A lid according to claim 1 wherein said valve is detachably mounted within said dispensing opening.

10. A lid according to claim 1 and further comprising a dispensing spout having a first end in communication with said dispensing opening and a second end facing in a downward direction when said lid is in said open position, said dispensing spout having a longitudinal tube axis, said second end of said spout being surrounded by an end edge of said spout which lies in a plane oblique to said longitudinal axis of said spout.

11. A lid according to claim 1 wherein said housing is detachably mounted to said lid for selective removal of said housing from said lid.

12. A lid according to claim 1 and further comprising a counterbalance assembly mounted to said lid for yieldably urging said lid toward said open position about said hinge.

13. A lid according to claim 12 wherein said counterbalance assembly comprises a torsion spring.

14. A lid according to claim 12 wherein said counterbalance assembly is detachably mounted to said lid.

15. The lid according to claim 1 wherein the valve is spring biased toward the closed position.

16. A lid for a washing machine having an upwardly presented access opening, comprising:

a lid frame having a front edge, a rear edge, side edges, an upper surface, and a lower surface;

a hinge connected to one of said lid frame edges permitting hinged attachment of said lid frame to said washing machine for pivotal movement between an open position wherein said upper and lower surfaces are upstanding and a closed position;

a housing carried on said lower surface of said lid frame and forming a dispensing chamber;

said housing having a fill opening providing communication into said dispensing chamber for filling said chamber with a fluid;

said housing having a dispensing opening forming communication from within to outside said dispensing chamber for permitting removal of said fluid from said dispensing chamber;

a manually operated dispensing valve mounted in said dispensing opening and manually movable from a normally closed position preventing fluid from leaving said chamber through said dispensing opening to an open position permitting fluid to exit through said dispensing opening when said lid frame is in said open position;

an indicator on said housing for visually representing the amount of fluid which has been dispensed from said dispensing chamber; and said dispensing opening being located above said access opening when said lid frame is in said open position whereby fluid exiting from said dispensing opening will fall by gravity into said access opening.

17. A lid according to claim 16 wherein said indicator further comprises a window in said housing permitting visual inspection of the level of fluid within said dispensing chamber.

18. A lid according to claim 17 and further comprising a marker attached to said window and movable to a plurality of positions with respect to said window to mark the level of said fluid within said dispensing chamber after a predetermined amount of said fluid has been dispensed.

19. A lid according to claim 17 wherein said housing includes a slide track formed adjacent said window, said marker being mounted within said slide track for sliding movement therein.

20. The lid according to claim 16 wherein the valve is spring biased toward the closed position.

21. A lid for a washing machine having an upwardly presented access opening, comprising:

a lid frame having a front edge, a rear edge, side edges, an upper surface, and a lower surface;

a hinge connecting the lid frame to the washing machine for movement between open and closed positions relative to the access opening;

a housing carried on said lower surface of said lid frame and forming a dispensing chamber;

said housing having a fill opening providing communication into said dispensing chamber for filling said chamber with a fluid;

said housing having a dispensing opening forming communication from within to outside said dispensing chamber for permitting dispensing of said fluid from said dispensing chamber;

a manually operated dispensing valve mounted in said dispensing opening and manually movable from a normally closed position preventing fluid from leaving said chamber through said dispensing opening to an open position permitting fluid to exit through said dispensing opening when said lid frame is in said open position;

said dispensing valve being detachably mounted in said dispensing opening and selectively removable therefrom for cleaning; and said dispensing opening being located above said access opening when said lid frame is in said open position whereby fluid exiting from said dispensing opening will fall by gravity into said access opening.

22. A lid according to claim 21 and further including a fill cap detachably connected to said fill opening.

23. A lid according to claim 21 and further comprising a retaining clip retentively engaging said valve and said housing for attaching said valve to said housing in said dispensing opening, said retaining clip being movable out of retentive engagement to permit removal of said valve from said dispensing opening.

24. A lid according to claim 23 wherein said housing includes a bore for receiving said valve and a clip slot for receiving said clip when said clip retentively engages said housing and said valve.

25. The lid according to claim 21 wherein the valve is spring biased toward the closed position.

26. A method for using a lid for a washing machine comprising a washing machine cabinet having an upwardly presented access opening therein, a lid frame, a hinge connected to said lid frame and said washing machine cabinet for permitting hinged movement of said lid about a hinge axis with respect to said washing machine, a housing on said lid frame forming an enclosed fluid retaining chamber, said housing having a fill opening and a dispensing opening therein, a fill cap detachably mounted over said fill opening and a valve mounted in said dispensing opening, said method comprising:

moving said lid frame about said hinge axis from a closed position wherein said lid frame is in covering relation over said washing machine access opening to an up-standing open position;

manually moving said valve from a normally closed position preventing fluid from exiting said chamber through said dispensing opening to an open position permitting fluid to exit said chamber through said dispensing opening when the lid is in the open position;

said dispensing opening being located above said access opening when said lid frame is in said open position whereby fluid exiting from said dispensing opening will fall by gravity into said access opening.

27. A method according to claim 26 wherein said chamber includes a dispensing chamber and a reservoir chamber, said fill opening providing communication into said reservoir chamber and said dispensing opening providing communication from said dispensing chamber, said method further comprising moving fluid from said reservoir chamber into said dispensing chamber before said step of moving said valve to said open position.

28. A method according to claim 27 wherein said dispensing chamber includes a charging opening providing fluid communication between said reservoir and said dispensing chamber, said method further comprising moving fluid from said reservoir chamber to said dispensing chamber through said charging opening.

29. A method according to claim 28 wherein said charging opening is oriented so that fluid will only flow through said charging opening by gravity from said reservoir chamber to said dispensing chamber when said lid is moved about said hinge axis to a predetermined position, said method comprising moving said lid to said predetermined position after said filling step to cause said fluid to move through said charging opening from said reservoir chamber to said dispensing chamber.

30. A method according to claim 29 wherein said predetermined position is said closed position, and the step of moving said lid to said predetermined position comprises moving said lid to said closed position.

31. A method according to claim 26 wherein said housing includes a viewing window therein, said method further comprising viewing the level of said fluid in said chamber during the time that said valve is in said open position to determine the quantity of said fluid which has passed out of said chamber through said dispensing opening.

32. A method according to claim 31 wherein said housing includes a movable gage member adjacent said window, said method further comprising moving said gage member to different preselected positions corresponding to levels of said fluid appearing through said viewing window when desired quantities of said fluid have been dispensed.

33. A method according to claim 26 and further comprising removing said valve from said dispensing opening for cleaning.

34. A method according to claim 33 and further comprising placing a clip in retentive engagement with said valve and said housing to retain said valve in said dispensing opening, said step of removing said valve comprising removing said clip from retentive engagement with said valve.

* * * * *